US011536470B2

(12) United States Patent
Shin et al.

(10) Patent No.: US 11,536,470 B2
(45) Date of Patent: Dec. 27, 2022

(54) OUTDOOR UNIT AND AIR CONDITIONER INCLUDING THE SAME

(71) Applicant: LG Electronics Inc., Seoul (KR)

(72) Inventors: Yongho Shin, Seoul (KR); Seungyup Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 292 days.

(21) Appl. No.: 16/811,871

(22) Filed: Mar. 6, 2020

(65) Prior Publication Data

US 2020/0284442 A1 Sep. 10, 2020

(30) Foreign Application Priority Data

Mar. 8, 2019 (KR) ..... 10-2019-0027116

(51) Int. Cl.
*F24F 1/10* (2011.01)
*F24F 1/16* (2011.01)
(Continued)

(52) U.S. Cl.
CPC ..... *F24F 1/10* (2013.01); *F24F 1/16* (2013.01); *F24F 1/26* (2013.01); *F24F 1/56* (2013.01);
(Continued)

(58) Field of Classification Search
CPC ..... F24F 1/10; F24F 1/12; F24F 1/30; F24F 1/56; F24F 2013/202; F16M 11/2014;
(Continued)

(56) References Cited

U.S. PATENT DOCUMENTS 364,479 A * 6/1887 Childs ..... A47B 49/004 312/319.2
1,924,662 A * 8/1933 Summers ..... F25D 23/006 248/655
(Continued)

FOREIGN PATENT DOCUMENTS

CN 207065741 3/2018
CN 207279840 4/2018
(Continued)

OTHER PUBLICATIONS

Korean Office Action in Korean Application No. 10-2019-0027116, dated Nov. 17, 2020, 16 pages (with English translation).
(Continued)

*Primary Examiner* — Christopher R Zerphey
(74) *Attorney, Agent, or Firm* — Fish & Richardson P.C.

(57) ABSTRACT

There is disclosed an outdoor unit comprising a case provided to define an exterior design and comprising a plurality of side panels having an inlet hole providing a path for sucking external air, a base plate supporting the plurality of the side panels, an upper panel having an outlet hole for discharging the external air sucked via the inlet hole to the outside; a heat-exchanger provided in the case and configured to exchange heat with the external air sucked via the inlet hole; a sliding plate slidingly provided in the base plate and supporting the compressor module and movable via the opening to expose the compressor module outside the case; and a compressor module configured to supply a refrigerant that exchanging heat with the external air to the heat-exchanger, such that the compressor module may be manipulative outside and demounted when the sliding plate is located in the exposure position.

14 Claims, 6 Drawing Sheets

(51) Int. Cl.

| | |
|---|---|
| ***F24F 1/26*** | (2011.01) |
| ***F24F 1/56*** | (2011.01) |
| ***F24F 13/20*** | (2006.01) |
| ***F24F 13/30*** | (2006.01) |

(52) U.S. Cl.
CPC ..... *F24F 13/20* (2013.01); *F24F 13/30* (2013.01); *F24F 2013/202* (2013.01)

(58) Field of Classification Search
CPC ..... A47B 49/004; A47B 49/006; F25D 19/02; F25D 23/006; F04B 39/14
See application file for complete search history.

(56) References Cited

U.S. PATENT DOCUMENTS

| | | | | | |
|---|---|---|---|---|---|
| 2,454,727 | A * | 11/1948 | Wherry | F25D 23/006 | 62/448 |
| 2,930,667 | A * | 3/1960 | Zearfoss, Jr. | E06B 3/4663 | 49/404 |
| 3,323,625 | A * | 6/1967 | Webster | B60H 1/3232 | 192/115 |
| 3,866,867 | A | 2/1975 | Larocca | | |
| 4,582,372 | A * | 4/1986 | Cooper | A47B 81/002 | 312/307 |
| 10,092,094 | B2 * | 10/2018 | Sagel | A47B 49/006 | |
| 10,168,082 | B2 * | 1/2019 | Troxell | F25B 49/02 | |
| 10,197,295 | B2 * | 2/2019 | Crespo-Calero | F24F 13/20 | |

FOREIGN PATENT DOCUMENTS

| | | |
|---|---|---|
| EP | 0126956 | 12/1984 |
| JP | S557359 | 1/1980 |
| JP | 2000111203 | 4/2000 |
| JP | 2013079807 | 5/2013 |
| JP | 201690166 | 5/2016 |
| KR | 1020050107116 | 11/2005 |
| KR | 1020060124393 | 12/2006 |
| KR | 1020100040086 | 4/2010 |
| KR | 1020140100045 | 8/2014 |
| WO | WO2008113219 | 9/2008 |

OTHER PUBLICATIONS

Notice of Allowance in Korean Appln. No. 10-2019-0027116, dated Jul. 12, 2021, 1 page (English translation).
Extended European Search Report in European Application No. 20161466.6, dated Jun. 2, 2020, 8 pages.
Korean Office Action in Korean Application No. 10-2019-0027116, dated May 13, 2020, 14 pages (with English translation).

* cited by examiner

OUTDOOR UNIT AND AIR CONDITIONER INCLUDING THE SAME

CROSS-REFERENCE TO RELATED APPLICATIONS

This application claims priority to Korean Patent Application No. 10-2019-0027116, filed on Mar. 8, 2019, the entire contents of which is hereby incorporated by reference in its entirety.

BACKGROUND OF THE DISCLOSURE

Embodiments of the present disclosure relate to an air conditioner, more particularly, an air conditioner that may facilitate the quick mounting or demounting of a compressor module in or from an outdoor unit.

An air conditioner is an air conditioning/heating device that includes a blowing fan configured to suck and discharge air and a heat-exchanger configured to exchange heat with the sucked air so as to heat or air-condition an a room by means of the air repeatedly discharged into the room after exchanging heat with a low-temperature or high-temperature refrigerant. Such an air conditioner may form a series of cycles configured of a compressor, a condenser, an expansion valve and an evaporator.

Generally, an outdoor unit of such the air conditioner may include an outdoor heat-exchanger configured to exchange heat between a refrigerant flowing therein and external air sucked therein; an outdoor fan installed near the outdoor heat exchanger and configured to provide a power used in sucking and discharging the external air; and a compressor configured to compress a low-temperature-low-pressure gas refrigerant into a high-temperature-and-high-pressure gas refrigerant.

The number of the compressors installed in the outdoor unit may be predetermined based on the design capacity of the air conditioner. In case of a large-capacity outdoor unit having two or more compressors, one of the compressors has to be necessarily installed in the outdoor unit. In this instance, the outdoor has the structure configured to unnecessarily demount the front compressor so as to separate the inner compressor.

In such the conventional structure, the front compressor operating normally does not have to be demounted. However, the front compressor has to be demounted so as to demount to the rear compressor inconveniently, if the rear compressor needs repairing or replacing.

SUMMARY OF THE DISCLOSURE

Accordingly, an object of the present disclosure is to address the above-noted and other problems.

Another object of the present disclosure is to provide an outdoor unit having a compressor module that may be mounted or demounted quickly and efficiently therein or therefrom, and an air conditioner including the same.

Another object of the present disclosure is to provide an outdoor unit having a compressor module that is arranged in a limited space thereof more efficiently, and an air conditioner including the same.

Another object of the present disclosure is to provide an outdoor unit that may reduce the vibration transmitted to a base plate supporting a compressor, and an air conditioner including the same.

Embodiments of the present disclosure may provide a compressor module installed on a drawer type sliding structure or a rotary sliding structure.

Embodiments of the present disclosure may also provide an outdoor unit comprising a case provided to define an exterior design and comprising a plurality of side panels having an inlet hole providing a path for sucking external air, a base plate supporting the plurality of the side panels, an upper panel having an outlet hole for discharging the external air sucked via the inlet hole to the outside; a heat-exchanger provided in the case and configured to exchange heat with the external air sucked via the inlet hole; a sliding plate slidingly provided in the base plate and supporting the compressor module and movable via the opening to expose the compressor module outside the case; and a compressor module configured to supply a refrigerant that exchanging heat with the external air to the heat-exchanger, such that the compressor module may be manipulative outside and demounted when the sliding plate is located in the exposure position.

The sliding plate may be linearly movable from the inside towards the outside of the case.

The base plate may include a linear guide rail linearly extending from the inside of the case towards the opening, and the sliding plate may include a linear roller movable along the linear guide rail; a linear roller housing projecting towards the base plate and rotatably accommodating the linear roller; and a linear roller rotary shaft installed in the linear roller housing and rotatably supporting the linear roller.

In a state where the sliding plate is located in the storage position, a first linear stopper may be provided to prevent the sliding plate from moving towards the inside from the outside of the case.

In a state where the sliding plate is located in the exposure positon, a second linear stopper may be provided to prevent the sliding plate from moving towards the outside from the inside of the case.

The sliding plate may be rotatable on a rotary shaft projecting towards the upper panel from the base plate.

The base plate may include a curved guide rail curvedly extending along a circumferential direction with respect to the rotary shaft, and the sliding plate may include a curved roller movable along the curved guide rail; a curved roller housing projecting towards the base plate and rotatably accommodating the curved roller; and a curved roller rotary shaft rotatably supporting the curved roller through at least predetermined area of the center of the curved roller.

The outdoor unit may further include a first rotation stopper provided in a corresponding position to one end of the curved guide rail and configured to preventing the sliding plate from rotating towards the inside of the case any further.

The outdoor unit may further include a second rotation stopper provided in a corresponding position to the other end of the curved guide rail and configured to prevent the sliding plate from rotating towards the opening any further.

One of the side panels may have an opening for providing a path of the sliding plate.

The outdoor unit may further include an opening/closing member coupled to the opening via a coupling member and configured to prevent the sliding plate from being exposed to the opening.

The base plate may include a door guide rail extending along a width direction of the side panel, and the outdoor unit may further include a sliding door slidingly coupled to the door guide rail to open and close the opening and configured to reciprocate.

The base plate may further include a first door stopper configured to restrict the moving distance of the sliding door moving to open the opening.

The base plate may further include a second door stopper configured to restrict the moving distance of the sliding door moving to close the opening.

The compressor module may include a plurality of compressors configured to compress the refrigerant; and a plurality of oil separators installed adjacent to the respective compressors and configured to separate oil from the refrigerant discharged from the compressors and return the oil to the respective compressors.

Embodiments of the present disclosure may also provide an air conditioner comprising: an outdoor unit a case provided to define an exterior design and comprising a plurality of side panels having an inlet hole providing a path for sucking external air, a base plate supporting the plurality of the side panels, an upper panel having an outlet hole for discharging the external air sucked via the inlet hole to the outside; a heat-exchanger provided in the case and configured to exchange heat with the external air sucked via the inlet hole; a sliding plate slidingly provided in the base plate and supporting the compressor module and movable via the opening to expose the compressor module outside the case; and a compressor module configured to supply a refrigerant that exchanging heat with the external air to the heat-exchanger; and an indoor unit connected with the compressor module or the heat-exchanger via a refrigerant path and configured to exchange heat with the refrigerant transmitted from the outdoor unit and transmit the heat-exchanged refrigerant to the compressor module or the heat-exchanger, wherein the outdoor unit further comprises a base plate provided in the case and supporting the heat-exchanger, and a sliding plate slidingly provided in the base plate and supporting the compressor module, and the sliding plate is movable via the opening to expose the compressor module outside the case, wherein the compressor module may be manipulative outside and demounted when the sliding plate is located in the exposure position.

According to the embodiment of the present disclosure, the present disclosure has the effect of providing the compressor module installed in the sliding plate configured to slide towards the outside.

In addition, the present disclosure has the effect of providing the services such as the mounting and demounting of the compressor module and the effect of providing the user's or service technician's working convenience and accessibility and dramatic reduction of the working time.

In addition, the present disclosure has the effect of providing the compressor and the oil separator installed in the sliding plate together so as to arrange the compressor module in the limited space more efficiently.

In addition, the present disclosure has the effect of providing the structure that is configured to dispose the sliding plate between the compressor module and base plate. Accordingly, the present disclosure may reduce the vibration transmitted to the base plate from the compressor module by means of the sliding plate.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and reference numerals means structural elements and wherein.

DESCRIPTION OF SPECIFIC EMBODIMENTS

Hereinafter, referring to the accompanying drawings, exemplary embodiment of a compressor according to the present disclosure will be described. Regardless of numeral references, the same or equivalent components may be provided with the same reference numbers and description thereof will not be repeated.

Terms such as "include" or "has" are used herein and should be understood that they are intended to indicate an existence of several components, functions or steps, disclosed in the specification, and it is also understood that greater or fewer components, functions, or steps may likewise be utilized.

For the sake of brief description with reference to the drawings, the sizes and profiles of the elements illustrated in the accompanying drawings may be exaggerated or reduced and it should be understood that the embodiments presented herein are not limited by the accompanying drawings.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Referring to the accompanying drawings, embodiments of the present disclosure will be described in detail.

Figure 1:
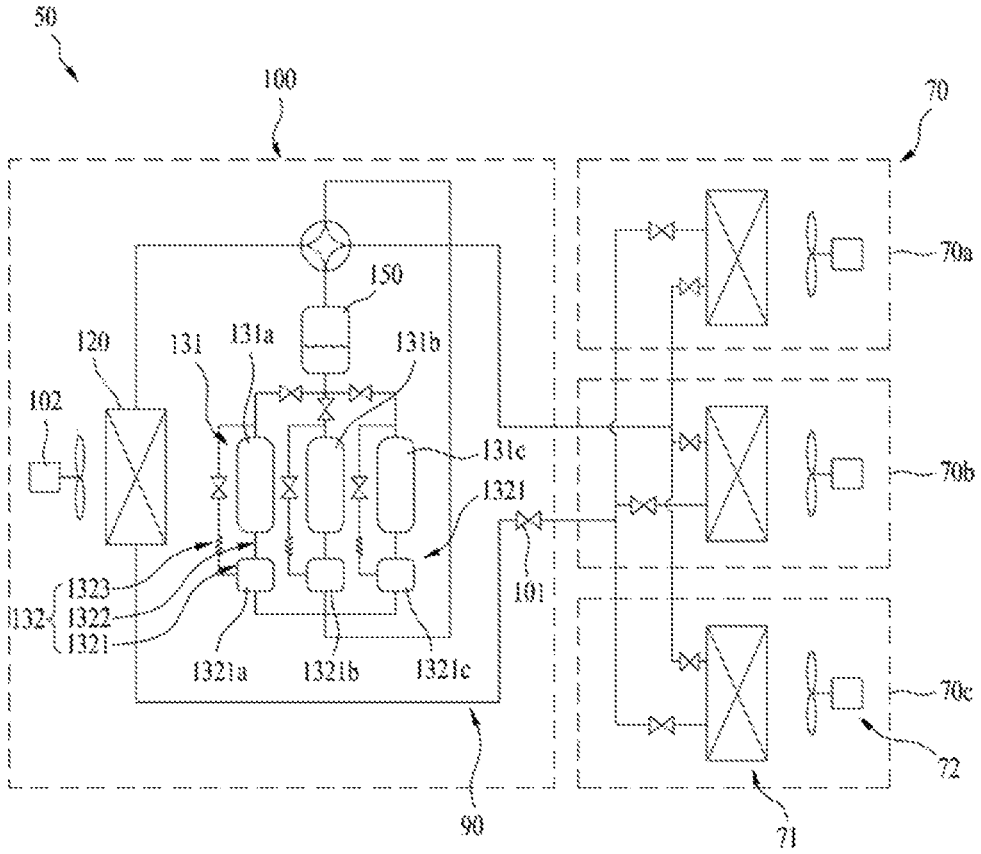
FIG. 1 is a conceptual diagram schematically illustrating a structure of an air conditioner including an outdoor unit according to one embodiment of the present disclosure.

FIG. 1 is a conceptual diagram schematically illustrating a structure of an air conditioner including an outdoor unit according to one embodiment of the present disclosure.

The air conditioner 50 according to one embodiment may include an indoor unit 70 and an outdoor unit 100. The indoor unit 70 and the outdoor unit 100 may be connected with each other via a refrigerant pipe 90. A refrigerant may be chill or heat a room while circulating the indoor unit 70 and the outdoor unit 100.

In the indoor unit 70 may be installed an indoor heat-exchanger 71 configured to exchange heat with room air and an indoor fan 72 configured to adjust air flow inside the indoor unit 70. The air conditioner 50 according to one embodiment may include a plurality of indoor units 70*a*, 70*b* and 70*c*.

In the outdoor unit 100 may be installed an outdoor heat-exchanger 120 configured to exchange heat with outdoor air and a compressor 131 configured to compress the refrigerant. A plurality of compressor 131 may be provided based on an air-conditioning (or air-heating or air-chilling) capacity. Here, the compressor 131 may be a constant velocity compressor or a variable capacity compressor.

The outdoor unit 100 may include an accumulator 150 configured to prevent a liquid refrigerant from leaking into the compressors 131. Also, the outdoor unit 100 may further include an expansion valve 101 configured to expand the heat-exchanged refrigerant and an outdoor fan 102 configured to adjust the air flow inside the outdoor unit 100.

In addition, the outdoor unit 100 may further include an oil collector 132. To secure the operation reliability of the compressor 131, a predetermined amount of oil for performing lubrication and chilling has to be maintained. For that, the coil collector 132 may be configured to separate soil from the refrigerant discharged from the compressor 131 and re-collect the oil in the compressor 131 so as to maintain the predetermined amount of the oil inside the compressor 131.

The coil collector 132 may include an oil separator 1321 configured to separate oil from the refrigerant transmitted from the compressor 131. A corresponding number of oil separators 1321 to the number of the compressors 131 may be provided. In other words, the soil separators 1321 may include a first oil separator 1321*a* connected with a first compressor 131*a*, a second oil separator 1321*b* connected with a second compressor 131*b*, and a third oil separator 1321*c* connected with a third compressor 131*c*.

In addition, the oil collector 132 may include a refrigerant discharge pipe 1322 for guiding the refrigerant discharged from the compressor towards the oil separator 1321, and an oil return pipe 1323 for collecting the soil separated by the oil separator 1321 in the compressor. A plurality of oil return pipes 1323 may be provided to connect the soil separators 1321 with the respective compressors 131.

Figure 3:
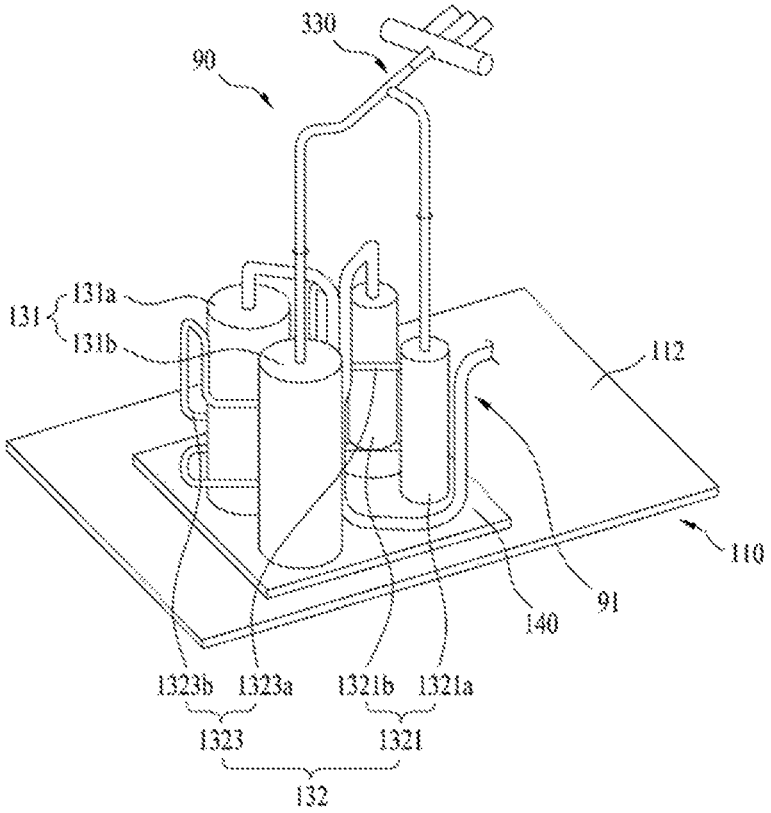
FIG. 3 is a perspective diagram schematically illustrating an inner structure of the outdoor unit shown in FIG. 1.
Figure 4:
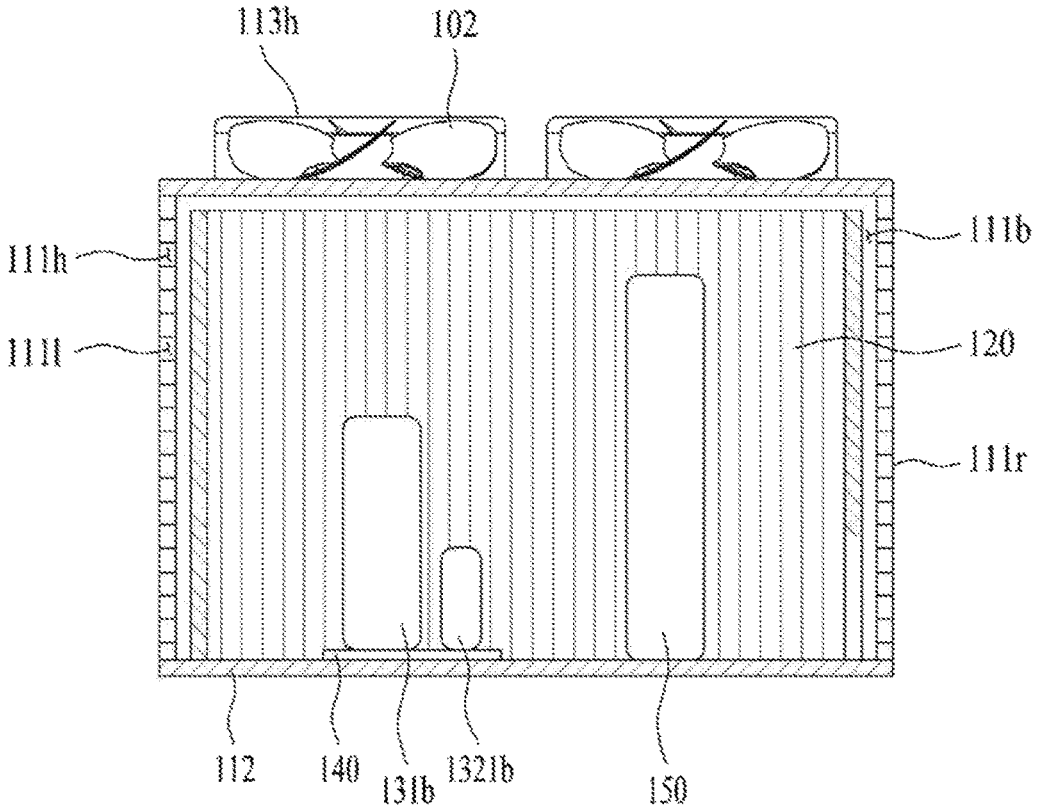
FIG. 4 is an side open view schematically illustrating the inner structure of the outdoor unit shown in FIG. 2.

Hereinafter, referring to FIGS. 2 through 4, the structure of the outdoor unit 100 according to embodiments of the present disclosure will be described in detail.

Figure 2:
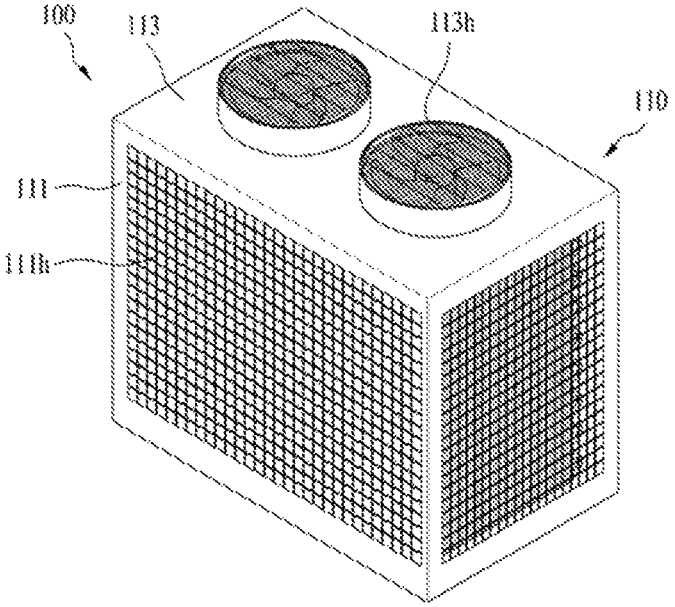
FIG. 2 is a perspective diagram illustrating an external design of the outdoor unit shown in FIG. 1.

FIG. 2 is a perspective diagram illustrating an external design of the outdoor unit shown in FIG. 1. FIG. 3 is a perspective diagram schematically illustrating an inner structure of the outdoor unit shown in FIG. 1. FIG. 4 is a side open view schematically illustrating the inner structure of the outdoor unit shown in FIG. 2.

The outdoor unit 100 may include a case 110 that defines an exterior design. The case 110 may include a plurality of side panels 111 having respective inlet holes 111*h* providing a path for sucking external air; a base plate 112 supporting the plurality of the side panels 111; and an upper panel 113 having an outlet hole 113*h* for re-discharging the air drawn into the case 110 towards the outside.

In the case 110 may be mounted an outdoor heat-exchanger 120, a compressor module 130 and a sliding plate 140.

Specifically, the compressor module 130 may include a plurality of compressors 131 configured to compress the refrigerant; and an oil collector 132 configured to separate oil from the refrigerant discharged from the compressors 131 and return the oil to the compressors.

The oil collector 132 may include the oil separator 1321 configured to separate oil from the refrigerant transmitted after discharged from the compressors and the oil return pip 1323 configured to connect the soil separator 1321 and the compressors 131 with each other.

In the case 110 may be installed a refrigerant pipe provided to connect the compressor 131, the outdoor heat-exchanger 120 and the oil collector 132 with each other to circulate the refrigerant in the compressor 131, the outdoor heat-exchanger and the oil collector 132.

In the case 110 may be mounted an accumulator 150 configured to separate a liquid refrigerant from the refrigerant flowing to the compressor 131. The accumulator 150 may be provided in the refrigerant inlet pipe 91 connected with the compressor 131.

Meanwhile, the compressor module 130 may slide with respect to the case 110 along the sliding plate 140 provided in a lower area. Also, the compressor module 130 may be installed in the case 110, in a state of being covered with a jacket to reduce noise.

The sliding plate 140 may slidingly installed in the base plate 112 and be configured to reciprocate between a storage position (see FIG. 5) for storing the entire area in the case and an exposure position (see FIG. 6) for exposing at least predetermined area to the outside of the case 110.

Hereinafter, referring to FIGS. 5 through 11, the sliding plate 140 according to embodiments of the present disclosure will be described in detail.

Figure 5:
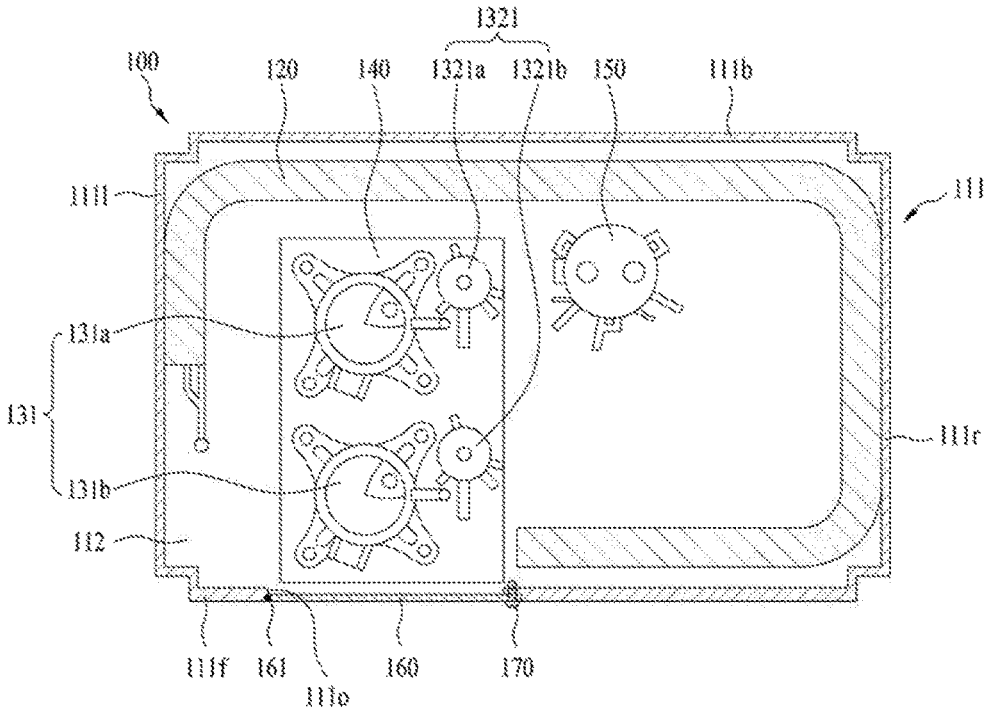
FIG. 5 is a conceptual diagram illustrating a sliding plate that is arranged in a storage position in the inner structure of the outdoor unit shown in FIG. 2, viewed from an upper area.
Figure 6:
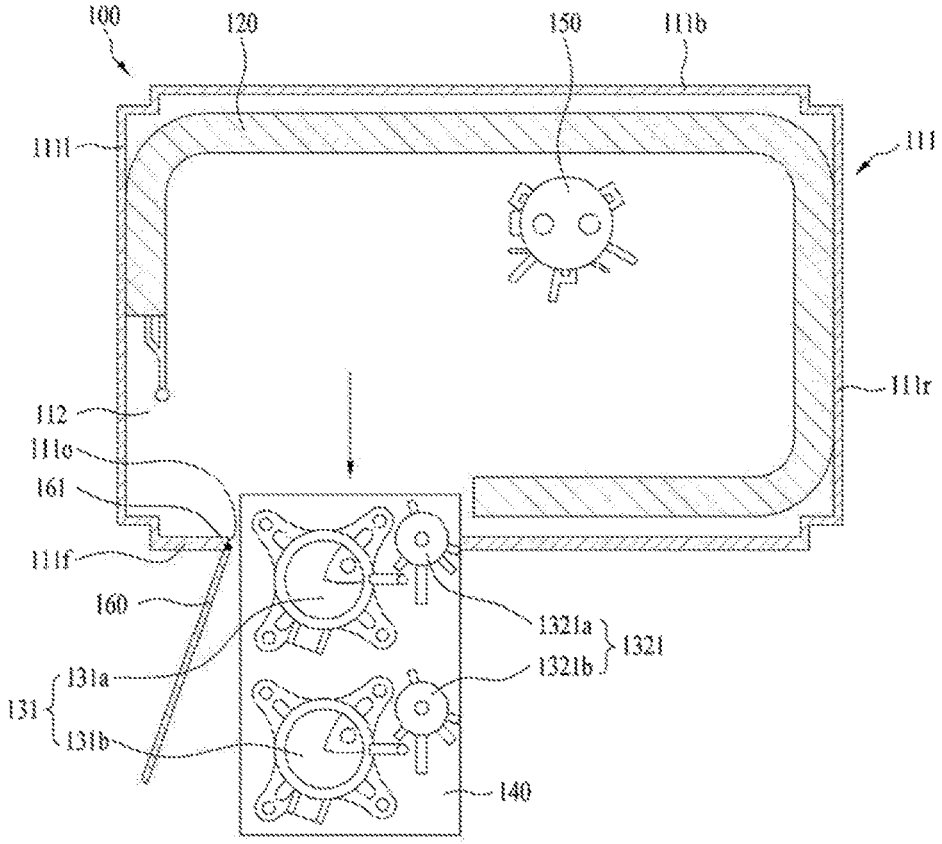
FIG. 6 is a conceptual diagram illustrating a sliding plate that is arranged in an exposure position in the inner structure of the outdoor unit shown in FIG. 2, viewed from an upper area.
Figure 7:
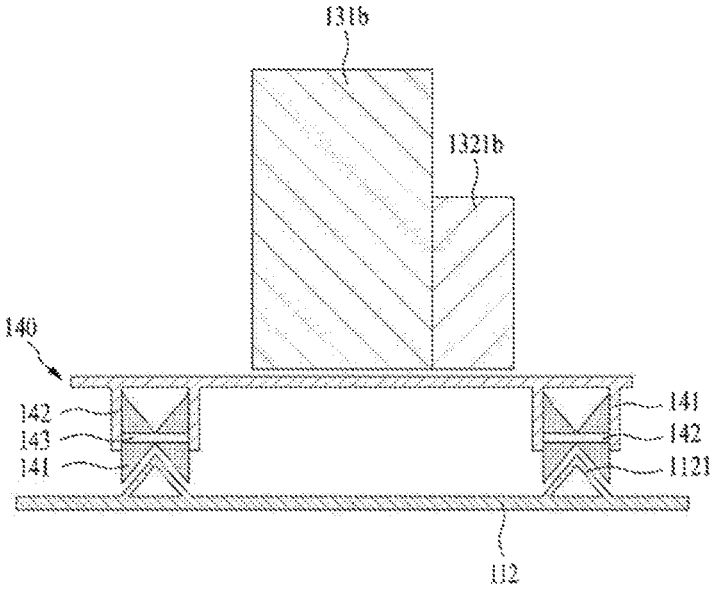
FIG. 7 is a conceptual diagram schematically illustrating a coupling structure between the compressor module and the sliding plate in the inner structure of the outdoor unit shown in FIGS. 5 and 6, viewed from a side area.

FIG. 5 is a conceptual diagram illustrating a sliding plate that is arranged in a storage position in the inner structure of the outdoor unit shown in FIG. 2, viewed from an upper area. FIG. 6 is a conceptual diagram illustrating a sliding plate that is arranged in an exposure position in the inner structure of the outdoor unit shown in FIG. 2, viewed from an upper area. FIG. 7 is a conceptual diagram schematically illustrating a coupling structure between the compressor module and the sliding plate in the inner structure of the outdoor unit shown in FIGS. 5 and 6, viewed from a side area.

Referring to FIGS. 5 and 6, the sliding plate 140 according to one embodiment may be characterized to be linearly movable from the inside towards the outside of the case. Under such a structure, when the sliding plate 140 is arranged in the exposure position shown in FIG. 6, the compressor module 130 may be characterized to be demountable from the outside.

Specifically, the compressor module 130 may be mounted in the sliding plate 140 as mentioned above. The compressor module 130 may include the plurality of the compressors 131, the soil collector 132 mounted adjacent to the respective compressors 131. As mentioned above, the respective compressors 131 may be connected with the oil separator 1321 via the refrigerant outlet pipe 1322 and the oil return pipe 1333 (see FIG. 1).

In the drawings, two compressors 131*a* and 131*b* are mounted in the case 110. However, the embodiments are not limited thereto. The number of the compressors 131 mounted in the case 110 may be determined based on the heating/chilling capacity of the air conditioner 50. As one example, one compressor may be mounted or three or more compressors (not shown) may be mounted. Here, the structure configured of two compressors 131*a* and 131*b* mounted on the sliding plate 140 within the case 110 may be exemplified.

Meanwhile, an opening 1110 may be formed in one of the side panels 111 to provide a path of the sliding plate 140. Specifically, the side panels 111 may include a left panel 11*a*1, a right panel 111*r*, a rear panel 111*b* and a front panel 111*f*. The opening 1110 may be formed in the front panel 111*f*. The structure for opening and closing the opening 1110 will be described later in detail.

The two compressors 131*a* and 131*b* may include a first compressor 131*a* mounted in an inner area of the case and a second compressor 132*b* mounted close to the front panel 111*f*.

When trying to check or repair the first compressor 131*a* mounted in the inner area of the case 110 in a state where no sliding plate 140 is provided, in other words, the two compressors 131*a* and 131*b* are mounted on the base plate 112, a user or service technician has to manipulate the first compressor 131*a* by inserting the hand or tool in the case 110.

To manipulate the first compressor 131*a*, the user or service technician has to demount the second compressor 131*b* from the base plate 112 even in a state where the second compressor 131*b* is normally operable. Accordingly, in case the broken compressor 131*a* is mounted in the inner area of the case 110 even when only one of the compressors 131*a* and 132*b* needs operating, even the other one 132*b* requiring no checking has to be demounted and the user or service technician has the limitation that he or she has to waste works or time in repairing the compressors 131.

To solve that limitation, the plurality of the compressors provided in the outdoor unit 100 according to one embodiment may be mounted in the sliding plate 140 that is independently provided from the base plate 112. The sliding plate 140 may be slidingly installed in the base plate 112. Under such a structure, the user or service technician does not have to demount the second compressor 131*b* that is operating normally to repair the first compressor 131*a* mounted in the inner area.

Instead, the user or service technician simply may open the front panel 111*f* and retract the sliding plate 140 outside the case 110 via the opening 111*o*, and conveniently manipulate the first compressor 131*a* exposed outside the case 110 along with the moving of the sliding plate 140 outside the case 110, only to demount it from the sliding plate 140.

The compressor module 130 is installed in the sliding plate 140 that is movable outside the outdoor unit 100. Accordingly, such services as the mounting and demounting of the compressor module 130 may be provided even in a state where the compressor module 130 is drawn outside the case 110 of the outdoor unit 100.

Accordingly, the user's and service technician's work convenience and accessibility may be improved and the working time may be dramatically reduced.

In addition, the plurality of the compressors 131 and the plurality of the oil separators 1321 and the refrigerant outlet pipe 1322 connecting the compressors 131 and the oil separates 1321 with each other and the oil return pipe 133 may be installed on the sliding plate 140 in the air conditioner. The compressor module 130 may be efficiently arranged in the limited inner space of the case 110 such that the outdoor unit 100 may be miniaturized.

The sliding plate 140 may be disposed between the base plate 112 and the compressor module 130 that is a key element of the outdoor unit 100 causing noise or vibration. Accordingly, the vibration transmitted to the base plate 112 from the compressor module may be reduced in the middle area of them.

Referring to FIGS. 5 through 7, the base plate 112 may include a linear guide rail 1121 projecting towards the upper panel 113 and linearly extending towards the outside from the inside of the case 110.

The sliding plate 140 may further include a linear roller 141 that is movable along the linear guide rail 1121; a linear roller housing 142 provided to rotatably accommodate the linear roller 141; and a linear roller shaft 143 installed in the linear roller housing 142 and configured to rotatably support the linear roller 141 through at least predetermined area of the center of the linear roller 141.

In addition, the sliding plate 140 may include a first linear stopper 144 configured to prevent the sliding plate 140 from moving towards the inside from the outside of the case 110 (towards an upper area of FIG. 5) in a state where the sliding plate 140 is located in the storage position (see FIG. 5).

The sliding plate 140 may further include a second linear stopper 145 configured to prevent the sliding plate 140 from moving towards the outside from the inside of the case (towards a lower area of FIG. 6) in a state where the sliding plate 140 is located in the exposure position (see FIG. 6).

Under such the structure, the sliding plate 140 may linearly reciprocate from the storage position and the exposure position based along the extending direction of the linear guide rail 1121 based on the user's manipulation.

The storage position of the sliding plate 140 may be defined by the first linear stopper 144 and the exposure position thereof may be defined by the second linear stopper 145.

Accordingly, even when the user continuously applies a power to the sliding plate 140 in a state where the sliding plate 140 is located in the storage or exposure position, the sliding plate 140 may not move more inner area of the case than the storage position and the exposure position. Also, it may not move more outer area of the case than the exposure position. Accordingly, the moving of the sliding plate 140 may be guided to stably reciprocate between the storage position and the exposure position.

Next, the opening and closing structure of the opening 1110 will be described in detail.

FIGS. 5 and 6 illustrate on example of the opening and closing structure. In other words, referring to FIGS. 5 and 6, the outdoor unit 100 may further include a rotary door 160 that is rotatable on a virtual line from the base plate 112 towards the upper panel 113 and rotatable between a closing position for closing the opening 1110 (see FIG. 5) and an open position for opening the opening 111*p* (see FIG. 6).

As one example, the rotary door 160 may be rotatable with respect to a door shaft 161 extending along a direction from the base plate 112 towards the upper panel. As another example, the rotary door 160 may be may be coupled to the front panel 111*f* via a hinge (not shown) although not shown in the drawings.

When located in the closing position, the rotary door 160 may be coupled to the front panel 111*f* via an auxiliary coupling member 170. As one example, the coupling member 170 may be a screw and the front panel 111*f* may include a screw hole (not shown) for inserting the coupling member 170 therein. Accordingly, the user may manipulate a fastening tool (e.g., a screw driver) and couple the rotary door to the front panel 111*f* However, embodiments are not limited thereto.

As an alternative example, the front panel 111*f* and the rotary door 160 may be coupled to each other via auxiliary coupling means (e.g., a door locker and a latch), in a state where the rotary door 160 is located in the closing position. As mentioned above, the front panel 1 if and the rotary door 160 may be coupled to each other in diverse coupling methods. The coupling structure shown in FIGS. 5 and 6, in other words, the structure configured to couple one side of the rotary shaft 161 installed in the rotary door 160 to one side of the front panel via the coupling member 170 may be adapted for easy description and the embodiments of the present disclosure are not limited thereto.

As one example, although not shown in the drawings, both sides of the rotary door 160 may be coupled to the front panel 111*f* via the coupling member 170 to close the opening 111*o*, without the door rotary shaft 161.

Referring to FIGS. 8 through 11, another modified example of the sliding plate (240 of FIGS. 8 through 11) will be described in detail.

Figure 8:
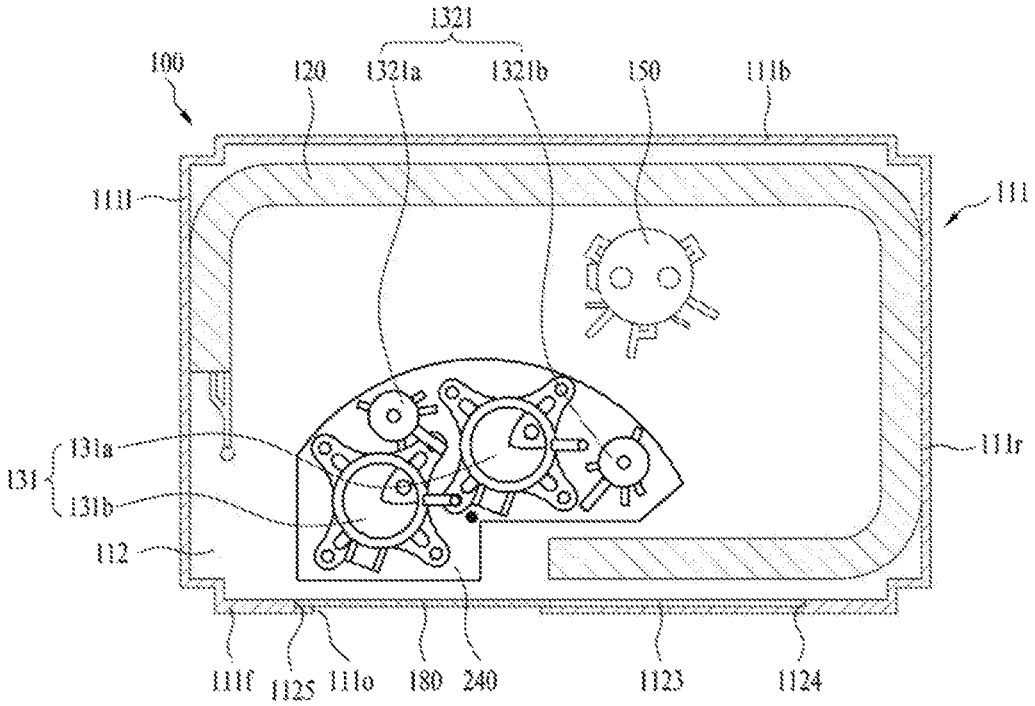
FIG. 8 is a conceptual diagram illustrating the sliding plate arranged in the storage position as another example of the inner structure shown in FIG. 5, viewed from an upper area.
Figure 9:
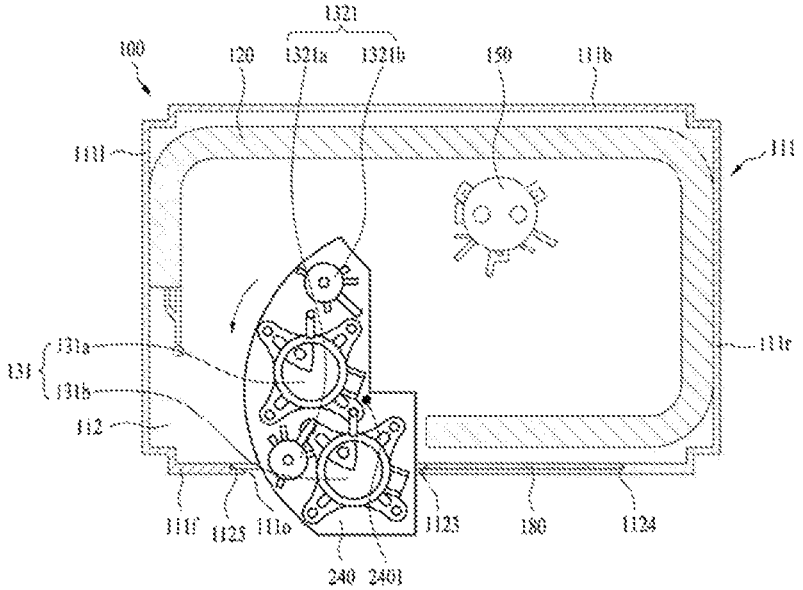
FIG. 9 is a conceptual diagram illustrating the sliding plate arranged in the exposure position in the inner structure of the outdoor unit shown in FIG. 8.
Figure 10:
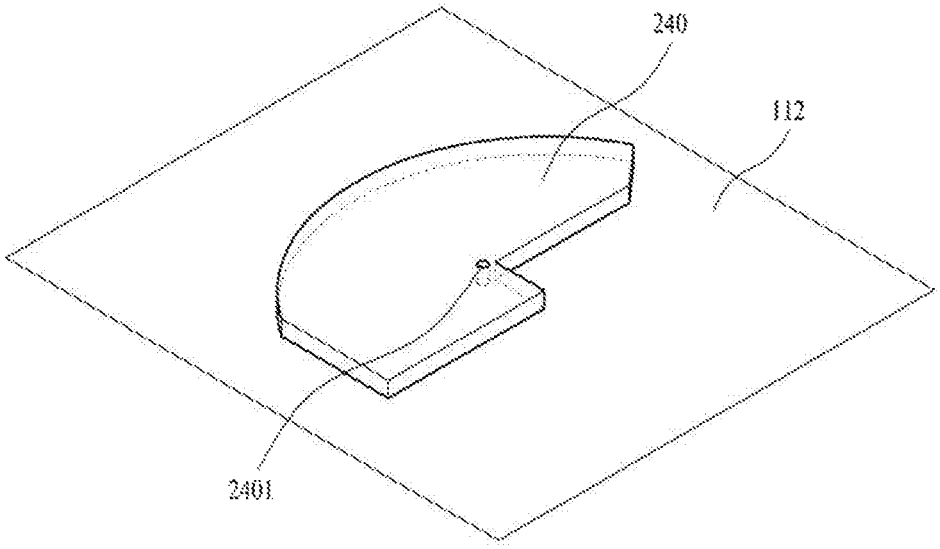
FIG. 10 is a perspective diagram schematically illustrating a coupling structure between the sliding plate and the base plate shown in FIG. 8.
Figure 11:
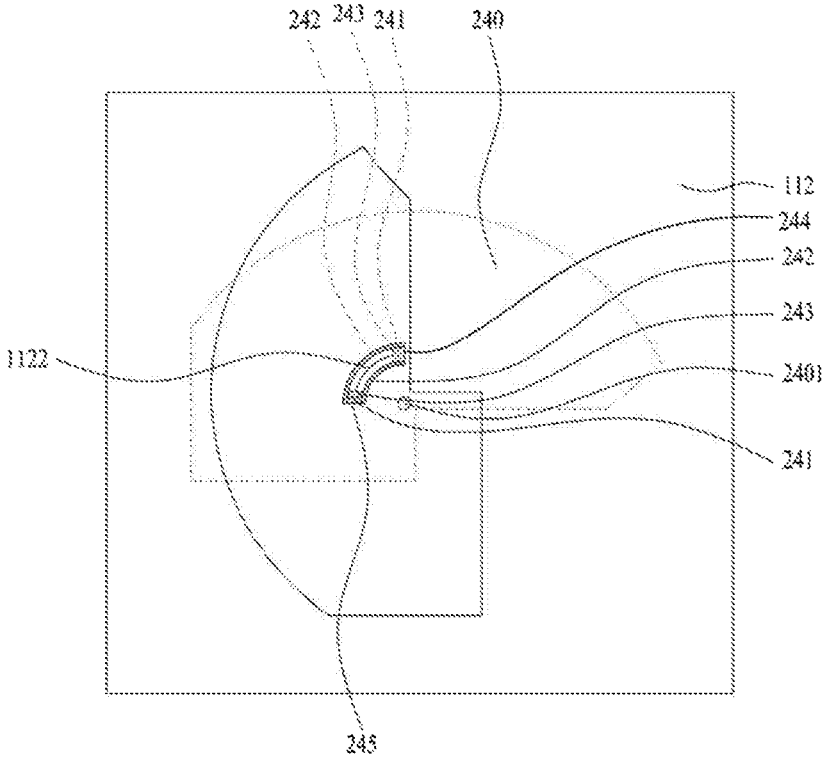
FIG. 11 is a perspective diagram schematically illustrating a coupling structure between the sliding plate and the base plate shown in FIG. 9.

FIG. 8 is a conceptual diagram illustrating the sliding plate arranged in the storage position as another example of the inner structure shown in FIG. 5, viewed from an upper area. FIG. 9 is a conceptual diagram illustrating the sliding plate arranged in the exposure position in the inner structure of the outdoor unit shown in FIG. 8. FIG. 10 is a perspective diagram schematically illustrating a coupling structure between the sliding plate and the base plate shown in FIG. 8. FIG. 11 is a perspective diagram schematically illustrating a coupling structure between the sliding plate and the base plate shown in FIG. 9.

Referring to FIGS. 8 and 9, the sliding plate 240 as another example may be rotatable on a rotary shaft 2401 projecting from the base plate 112 towards the upper panel 113. Under such a structure, the compressor module 130 may be manipulative outside and demountable when the sliding plate 240 is located in an exposure position shown in FIG. 9.

Specifically, the compressor module 130 may be installed in the sliding plate 240 as mentioned above. The compressor module 130 may include the plurality of the compressors 131 and the oil collectors 132 installed adjacent to the respective compressors 131. As mentioned above, the compressors may be connected with the respective oil separator via the refrigerant outlet pipe 1322 and the oil return pipes 1333.

It is shown in the drawings that two compressors 131*a* and 131*b* are mounted in the case 110 but embodiments are not limited thereto. The number of the compressors 131 may be determined based on the heating/chilling capacity of the air conditioner 50. As one example, one compressor may be installed and three or more compressors (not shown) may be installed. Hereinafter, two compressors 131*a* and 131*b* are mounted on the inner sliding plate 240 for easy description.

Meanwhile, an opening 1110 may be formed in one of the side panels 111 to provide a moving path of the sliding plate 240. Specifically, the plurality of the side panels 111 may include a left panel 111*l*, a right panel 111*r*, a rear panel 111*b* and a front panel 111*f* based on the arrangement structure shown in the drawings. The opening 1110 may be formed in the front panel 111*f* and the opening and closing structure of the opening 1110 will be described in detail.

The two compressors 131*a* and 131*b* may include a first compressor 131*a* mounted in an inner area of the case and a second compressor 132*b* mounted close to the front panel 111*f*.

When trying to check or repair the first compressor 131*a* mounted in the inner area of the case 110 in a state where no sliding plate 140 is provided, in other words, the two compressors 131*a* and 131*b* are mounted on the base plate 112, a user or service technician has to manipulate the first compressor 131*a* by inserting the hand or tool in the case 110.

To manipulate the first compressor 131*a*, the user or service technician has to demount the second compressor 131*b* from the base plate 112 even in a state where the second compressor 131*b* is normally operable. Accordingly, in case the broken compressor 131*a* is mounted in the inner area of the case 110 even when only one of the compressors 131*a* and 132*b* needs operating, even the other one 132*b* requiring no checking has to be demounted and the user or service technician has the limitation that he or she has to waste works or time in repairing the compressors 131.

To solve that limitation, the plurality of the compressors provided in the outdoor unit 100 according to one embodiment may be mounted in the sliding plate 240 that is independently provided from the base plate 112. The sliding plate 240 may be slidingly installed in the base plate 112. Under such a structure, the user or service technician does not have to demount the second compressor 131*b* that is operating normally to repair the first compressor 131*a* mounted in the inner area.

Instead, the user or service technician simply may open the front panel 111*f* and retract the sliding plate 240 outside the case 110 via the opening 111*o*, and conveniently manipulate the first compressor 131*a* exposed outside the case 110 along with the moving of the sliding plate 240 outside the case 110, only to demount it from the sliding plate 240.

The compressor module 130 is installed in the sliding plate 240 that is movable outside the outdoor unit 100. Accordingly, such services as the mounting and demounting of the compressor module 130 may be provided even in a state where the compressor module 130 is drawn outside the case 110 of the outdoor unit 100. Accordingly, the user's and service technician's work convenience and accessibility may be improved and the working time may be dramatically reduced.

In addition, the plurality of the compressors 131 and the plurality of the oil separators 1321 and the refrigerant outlet pipe (1322, see FIG. 1) connecting the compressors 131 and the oil return pipes (1323, see FIG. 1) with each other and the oil return pipe 133 may be installed on the sliding plate 240 in the air conditioner. The compressor module 130 may be efficiently arranged in the limited inner space of the case 110 such that the outdoor unit 100 may be miniaturized.

The sliding plate 240 may be disposed between the base plate 112 and the compressor module 130 that is a key element of the outdoor unit 100 causing noise or vibration. Accordingly, the vibration transmitted to the base plate 112 from the compressor module may be reduced in the middle area of them.

More specifically, referring to FIGS. 8 through 11, the base plate 112 may include a curved guide rail 1122 projecting towards the upper panel 113 and curvedly extending along a circumferential direction with respect to the rotary shaft 2401.

The sliding plate 240 may further include a curbed roller 241 that is movable along the curved guide rail 1122; a curved roller housing 242 provided to rotatably accommodate the curved roller 241; and a curved roller shaft 243 configured to rotatably support the curved roller 241 through at least predetermined area of the center of the curved roller 241.

In addition, the sliding plate 240 may include a first rotation stopper 244 configured to prevent the sliding plate 240 from rotating towards the storage position (see FIG. 8) from the exposure position (see FIG. 9) (in other words, a clockwise direction in the drawing) in a state where the sliding plate 240 is located in the storage position (see FIG. 8).

The sliding plate 240 may further include a second rotation stopper 245 configured to prevent the sliding plate 240 from rotating towards the exposure position (see FIG. 9) from the storage position (see FIG. 8) (in a counter-clockwise direction in the drawing) in a state where the sliding plate 240 is located in the exposure position (see FIG. 9).

Under such the structure, the sliding plate 240 may reciprocate in the extending direction of the curved guide rail 1122 based on the user's manipulation. In other words, the sliding plate 240 may reciprocate between the storage position and the exposure position along a circumferential direction with respect to the rotary shaft 2401.

The storage position of the sliding plate 240 may be defined by the first rotation stopper 244 and the exposure position thereof may be defined by the second rotation stopper 245. Accordingly, even when the user continuously applies a power to the sliding plate 240 in a state where the sliding plate 240 is located in the storage or exposure position, the sliding plate 240 may not move more inner area of the case than the storage position and the exposure position (e.g., a clockwise direction). Also, it may not move more outer area of the case than the exposure position (e.g., a counter-clockwise direction). Accordingly, the moving of the sliding plate 240 may be guided to stably reciprocate between the storage position and the exposure position.

Next, one modified example of the opening and closing structure of the opening 1110 will be described in detail.

Referring to FIGS. 8 and 9 again, the base plate 112 may include a door guide rail 1123 projecting towards the upper panel 113 and extending along the side panel 111.

The outdoor unit 100 may further include a sliding door 180 slidingly coupled to the door guide rail 1123 and configured to reciprocate between a closing position for closing the opening 1110 (see FIG. 8) and an open position for opening the opening 111*o*.

The base plate 112 may further a first door stopper 1124 configured to prevent the sliding door 180 from moving from the closing position (see FIG. 8) towards the opening position (see FIG. 9) (e.g., in a right direction), in a state where the sliding door 180 is located in the opening position.

The base plate 112 may further include a second door stopper 1125 configured to prevent the sliding door 180 from moving from the opening position (see FIG. 9) towards the closing position (see FIG. 8) (e.g., in a left direction), in a state where the sliding door 180 is located in the closing position.

Under the structure, the sliding door 180 may reciprocate between the closing position and the opening position and between the first door stopper 1124 and the second door stopper 1125 based on the user's manipulation.

Meanwhile, although not shown in the drawings, even the sliding door 180 may be coupled to the front panel 111*f* of the side panels 111 via an auxiliary coupling member 170 like the rotary door 160 shown in FIGS. 5 and 6.

In other words, the coupling structure of the front panel 111*f* and the sliding door 180 may be applied to the coupling structure between the rotary door 160 using the coupling member 170. Accordingly, detailed description thereof is omitted.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. An outdoor unit comprising:

a case including an opening and an inlet hole configured to enable entry of external air into the case, the case defining an exterior of the outdoor unit;

a heat-exchanger located in the case and configured to exchange heat with the external air that entered the case via the inlet hole;

a compressor module connected with the heat-exchanger and configured to supply a refrigerant that exchanges heat between the external air and the heat-exchanger;

a base plate located in the case and configured to support the heat-exchanger;

a sliding plate that is located on the base plate, that is configured to support the compressor module, and that is configured to slide; and a rotary shaft coupled to the sliding plate and configured to assist rotation of the sliding plate towards the opening of the case, wherein the sliding plate is configured to slide at least partially out of the case via the opening of the case to expose a predetermined area of the compressor module, wherein the base plate comprises a curved guide rail that extends along a circumferential direction with respect to and around the rotary shaft, and wherein the sliding plate comprises:

a curved roller configured to move along the curved guide rail, a curved roller housing that faces the base plate and that is configured to accommodate the curved roller, a curved roller rotary shaft in contact with at least a predetermined area of a center of the curved roller and configured to rotatably support the curved roller, a first rotation stopper located in a position corresponding to a first end of the curved guide rail and configured to block the sliding plate from further rotating towards the inside of the case, and a second rotation stopper located in a position corresponding to a second end of the curved guide rail that is closer to the opening than the first end of the curved guide rail and configured to block the sliding plate from further rotating towards the opening.

2. The outdoor unit of claim 1, wherein the compressor module comprises a refrigerant pipe connected with the heat-exchanger and configured to transmit the refrigerant from the compressor module to the heat-exchanger, and wherein the refrigerant pipe is detachable from the heat-exchanger or the compressor module.

3. The outdoor unit of claim 1, wherein the case comprises a plurality of side panels coupled to the base plate.

4. The outdoor unit of claim 3, further comprising:

a door coupled to the opening of the case via a screw and configured to, in a closed position, block the sliding plate from being moved to the outside of the case.

5. The outdoor unit of claim 3, wherein the base plate comprises a door guide rail extending along a width direction of the side panel, and wherein the outdoor unit further comprises a sliding door coupled to the door guide rail and configured to open and close the opening along the door guide rail.

6. The outdoor unit of claim 5, wherein the base plate further comprises a first door stopper configured to stop movement of the sliding door based on the sliding door moving to an open position in which the opening is open.

7. The outdoor unit of claim 5, wherein the base plate further comprises a second door stopper configured to stop movement of the sliding door based on the sliding door moving to a closed position in which the opening is closed.

8. The outdoor unit of claim 1, further comprising:

a rotary door rotatably coupled to one side of the opening and configured to open and close the opening.

9. The outdoor unit of claim 8, further comprising a hinge that rotatably couples the rotary door with the opening.

10. The outdoor unit of claim 1, wherein the curved guide rail extends around the rotary shaft such that a distance between the curved guide rail and the rotary shaft is maintained.

11. The outdoor unit of claim 1, wherein the curved guide rail is disposed below the sliding plate based on the sliding plate being rotated to the first end of the curved guide rail.

12. An air conditioner comprising:

an outdoor unit comprising a case including an opening and an inlet hole configured to enable entry of external air into the case, the case defining an exterior of the outdoor unit, a heat-exchanger located in the case and configured to exchange heat with the external air that entered the case via the inlet hole, and a compressor module connected with the heat-exchanger and configured to supply a refrigerant that exchanges heat between the external air and the heat-exchanger; and an indoor unit connected with the compressor module of the outdoor unit or the heat-exchanger of the outdoor unit via a refrigerant path and configured to exchange heat by circulating the refrigerant between the indoor unit and the compressor module or the heat-exchanger of the outdoor unit, wherein the outdoor unit further comprises a base plate located in the case and configured to support the heat-exchanger, a sliding plate that is located on the base plate, that is configured to support the compressor module, and that is configured to slide, and a rotary shaft coupled to the sliding plate and configured to assist rotation of the sliding plate towards the opening of the case, and wherein the sliding plate is configured to slide at least partially out of the case via the opening of the case to expose a predetermined area of the compressor module, wherein the base plate comprises a curved guide rail that extends along a circumferential direction with respect to and around the rotary shaft, and wherein the sliding plate comprises:

a curved roller configured to move along the curved guide rail, a curved roller housing that faces the base plate and that is configured to accommodate the curved roller, a curved roller rotary shaft in contact with at least a predetermined area of a center of the curved roller and configured to rotatably support the curved roller, a first rotation stopper located in a position corresponding to a first end of the curved guide rail and configured to block the sliding plate from further rotating towards the inside of the case, and a second rotation stopper located in a position corresponding to a second end of the curved guide rail that is closer to the opening than the first end of the curved guide rail and configured to block the sliding plate from further rotating towards the opening.

13. The air conditioner of claim 12, wherein the curved guide rail extends around the rotary shaft such that a distance between the curved guide rail and the rotary shaft is maintained.

14. The air conditioner of claim 12, wherein the curved guide rail is disposed below the sliding plate based on the sliding plate being rotated to the first end of the curved guide rail.

* * * * *